US011045924B2

(12) United States Patent
Hsieh

(10) Patent No.: US 11,045,924 B2
(45) Date of Patent: Jun. 29, 2021

(54) FOLDING TORQUE WRENCH WITH FAST ADJUSTABLE TORQUE VALUE

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 214 days.

(21) Appl. No.: 15/848,008

(22) Filed: Dec. 20, 2017

(65) Prior Publication Data

US 2019/0160635 A1 May 30, 2019

(30) Foreign Application Priority Data

Nov. 24, 2017 (TW) ..... 106141055

(51) Int. Cl.
*B25B 13/46* (2006.01)
*B25B 23/142* (2006.01)
*B25B 23/00* (2006.01)

(52) U.S. Cl.
CPC ..... *B25B 13/462* (2013.01); *B25B 23/0007* (2013.01); *B25B 23/1427* (2013.01)

(58) Field of Classification Search
CPC ..... B25B 13/462; B25B 23/0007; B25B 23/1427
USPC ..... 81/478
See application file for complete search history.

(56) References Cited

U.S. PATENT DOCUMENTS 2,205,501 A * 6/1940 Sunnen ..... B25B 23/1427 81/478
4,485,703 A * 12/1984 Grabovac ..... B25B 23/1427 81/483
5,546,816 A * 8/1996 Jansson ..... B25B 23/1427 73/847
5,988,691 A * 11/1999 Cruickshank ..... F16L 58/1009 285/55

(Continued)

FOREIGN PATENT DOCUMENTS

GB 504084 4/1939

OTHER PUBLICATIONS

Norbar 4R 3/4 inch N.m/Lbf.ft Industrial Torque Wrench drawings marked 05/05; 3 pages; Norbar Torque Tools Ltd.; published online on May 19, 2006.

*Primary Examiner* — Hadi Shakeri
(74) *Attorney, Agent, or Firm* — Guice Patents PLLC

(57) ABSTRACT

A folding torque wrench includes a bar body, a connection rod the front end of which is pivotally connected with the bar body, a tubular body fitted on the connection rod and a torque adjustment mechanism having at least one elastic member and an adjustment member. A threaded section of rear end of the connection rod is screwed in a threaded hole of the adjustment member. The threaded section of the connection rod and the threaded hole of the adjustment member are formed as a first threaded section and a second threaded section. The first threaded section is at least double-start threads. When rotating the adjustment member by one circle, the adjustment member is moved in the longitudinal direction of the connection rod by a travel, which is over two time the pitch of the first threaded section. The torque value of the wrench can be quickly greatly adjusted only by means of rotating the adjustment member by few circles.

10 Claims, 8 Drawing Sheets

(56) References Cited

U.S. PATENT DOCUMENTS

| | | | | |
|---|---|---|---|---|
| 6,241,736 | B1 * | 6/2001 | Sater | A61B 17/0483 606/104 |
| 7,296,501 | B2 * | 11/2007 | Leek | B25B 13/481 52/704 |
| 7,707,916 | B2 * | 5/2010 | Pirseyedi | B25B 13/44 279/64 |
| 8,671,607 | B2 * | 3/2014 | Laney | F41A 3/18 42/51 |
| 9,452,517 | B2 | 9/2016 | Hsieh | |
| 9,506,708 | B2 * | 11/2016 | Peterson | F41C 23/14 |
| 9,950,412 | B2 * | 4/2018 | Fang | B25B 23/1427 |
| 2014/0352503 | A1 * | 12/2014 | Hsieh | B25B 23/1427 81/478 |
| 2017/0021250 | A1 * | 1/2017 | Milleman | A63B 53/0466 |

* cited by examiner

FOLDING TORQUE WRENCH WITH FAST ADJUSTABLE TORQUE VALUE

BACKGROUND OF THE INVENTION

1. Field of the Invention

The present invention relates generally to a torque wrench, and more particularly to a folding torque wrench, the torque value of which can be quickly adjusted.

2. Description of the Related Art

A torque wrench can be set with a torque value. When the applied torque of the torque wrench reaches the set torque value, the torque wrench will have a specific motion to remind an operator to stop wrenching.

A mechanical torque wrench has an elastic member inside. When adjusting the set torque value of the torque wrench, the elastic energy of the elastic member is changed. FIG. 1 shows a conventional folding torque wrench 10, which is a mechanical torque wrench. The folding torque wrench 10 has a front portion 11 and a front portion 12 pivotally connected with each other. An adjustment button 15 is screwed in the front portion 12 for adjusting the set torque value. When the operation torque of the wrench 10 reaches the set torque value, the front portion 11 and the front portion 12 will relatively bend around two pivotal connection sections 13, 14 as rotational fulcrums.

Please refer to FIG. 2. The front end of the adjustment button 15 has a threaded hole 16. A thread 171 of a rod member 17 is screwed in the threaded hole 16. When rotating the adjustment button 15, the adjustment button 15 is moved in the axial direction of the rod member 17 so as to increase or decrease the elastic energy of an elastic member 18 and adjust the set torque value of the wrench 10.

Such folding torque wrench is a professional wrench specifically applied to a large-size threaded member. The torque applied by such folding torque wrench always has a great value. Also, the torque value of such folding torque wrench is often adjusted within a larger range, but a small range, for example, from 600 pound-feet to 700 pound-feet. However, in such conventional folding torque wrench, the adjustment member 15 and the rod member 17 are both designed with single-start threads. When adjusting the torque value, the adjustment member 15 is displaced in the axial direction of the rod member 17 by a small distance. Therefore, it is necessary to rotate the adjustment member 15 by many circles to reach the needed torque value. This is time-consuming and needs to be improved.

SUMMARY OF THE INVENTION

It is therefore a primary object of the present invention to provide a folding torque wrench, the torque value of which can be quickly adjusted and set.

To achieve the above and other objects, the folding torque wrench of the present invention includes:

a bar body, a drive head being disposed at a front end of the bar body, a first pivotal connection section and a second pivotal connection section being disposed at a rear end of the bar body;

a connection rod having a pivotal connection end and a rod body, a threaded section being disposed at a rear end of the rod body, the pivotal connection end of the connection rod being pivotally connected with the first pivotal connection section of the bar body;

a tubular body fitted on the connection rod and slidable relative to the connection rod;

a linking mechanism mounted on a circumference of the tubular body and pivotally connected with the second pivotal connection section of the bar body; and a torque adjustment mechanism having at least one elastic member and an adjustment member, the adjustment member being formed with a threaded hole, the threaded section of the connection rod being screwed in the threaded hole, two ends of the elastic member respectively abutting against the adjustment member and an abutment section of the tubular body, the threaded section of the connection rod and the threaded hole of the adjustment member being respectively formed as a first threaded section and a second threaded section, the first threaded section being multi-start threads of at least double-start threads, whereby when rotating the adjustment member by one circle, the adjustment member is moved in the longitudinal direction of the connection rod by a travel, which is at least two time the pitch of the first threaded section.

Accordingly, the displacement travel of the adjustment member is at least two time the pitch of the first threaded section. The set torque value of the wrench can be greatly adjusted only by means of rotating the adjustment member by few circles. Therefore, the torque value of the wrench can be quickly adjusted.

The present invention can be best understood through the following description and accompanying drawings, wherein:

DETAILED DESCRIPTION OF THE PREFERRED EMBODIMENTS

Figure 1:
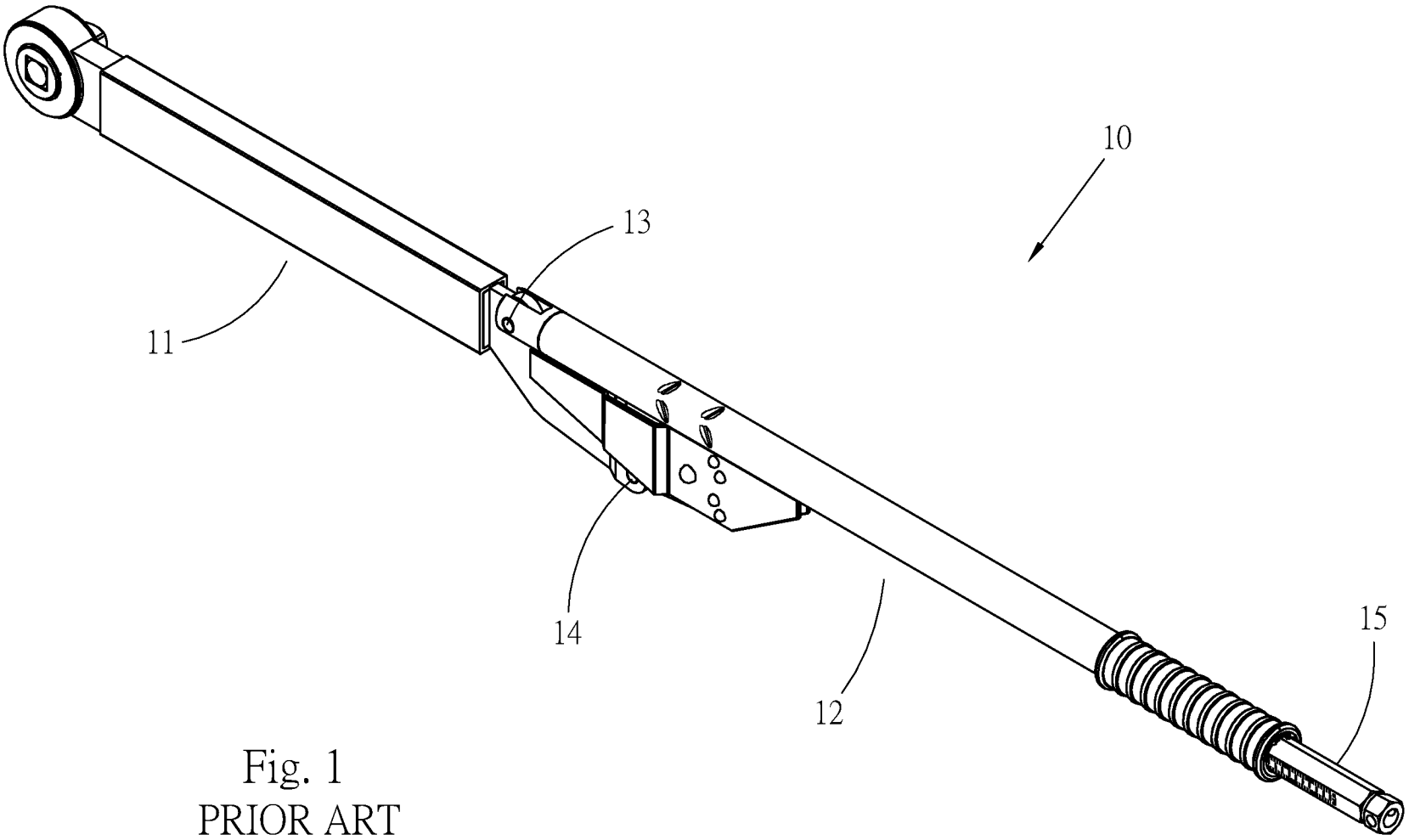
Fig. 1 PRIOR ART
FIG. 1 is a perspective view of a conventional folding torque wrench.
Figure 2:
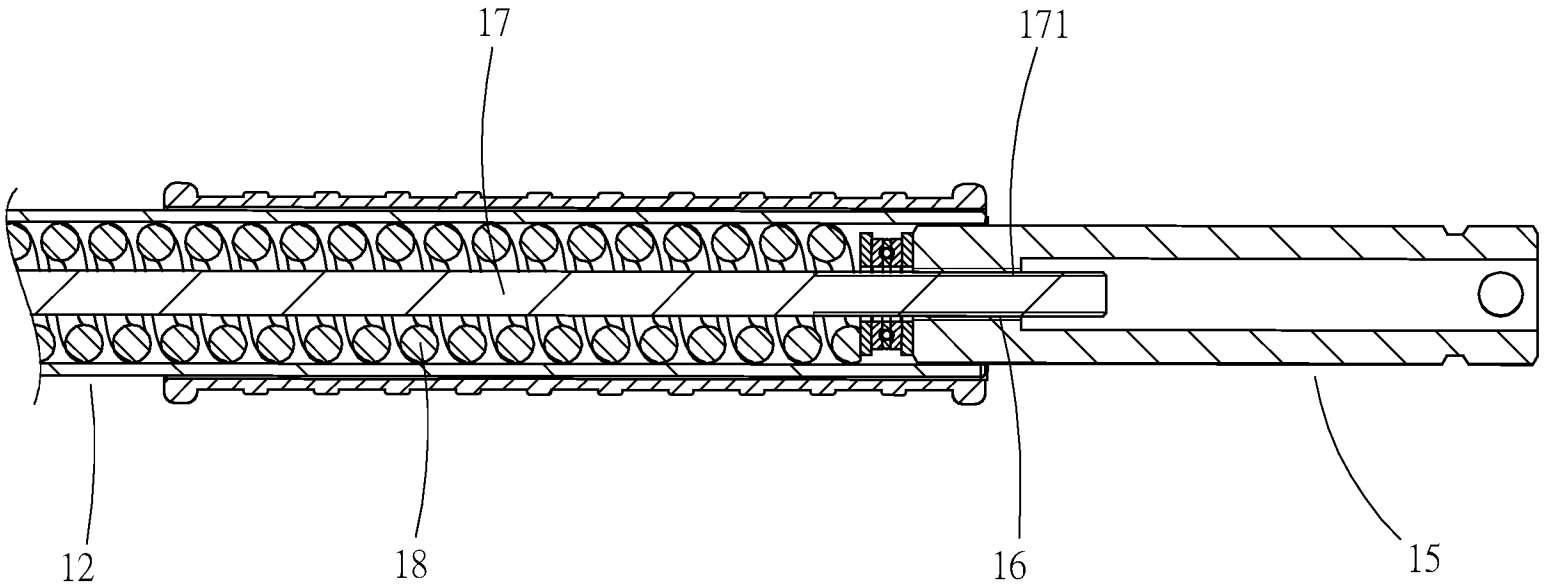
Fig. 2 PRIOR ART
FIG. 2 is a sectional view of the rear end of the conventional folding torque wrench according to FIG. 1.
Figure 3:
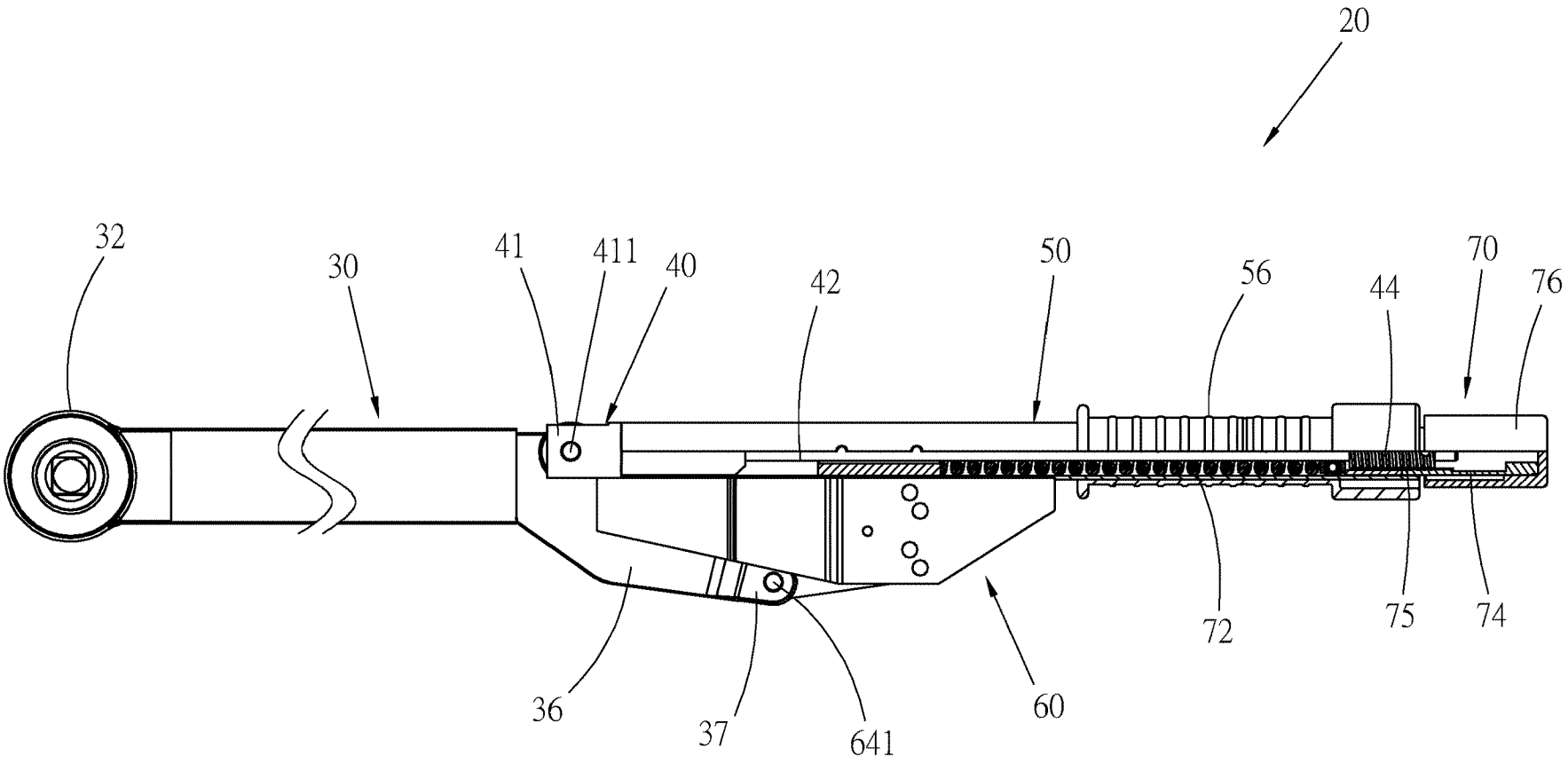
FIG. 3 is a front view of a preferred embodiment of the folding torque wrench of the present invention, in which one half side of the tubular body of the wrench is sectioned to show the inside of the tubular body.
Figure 4:
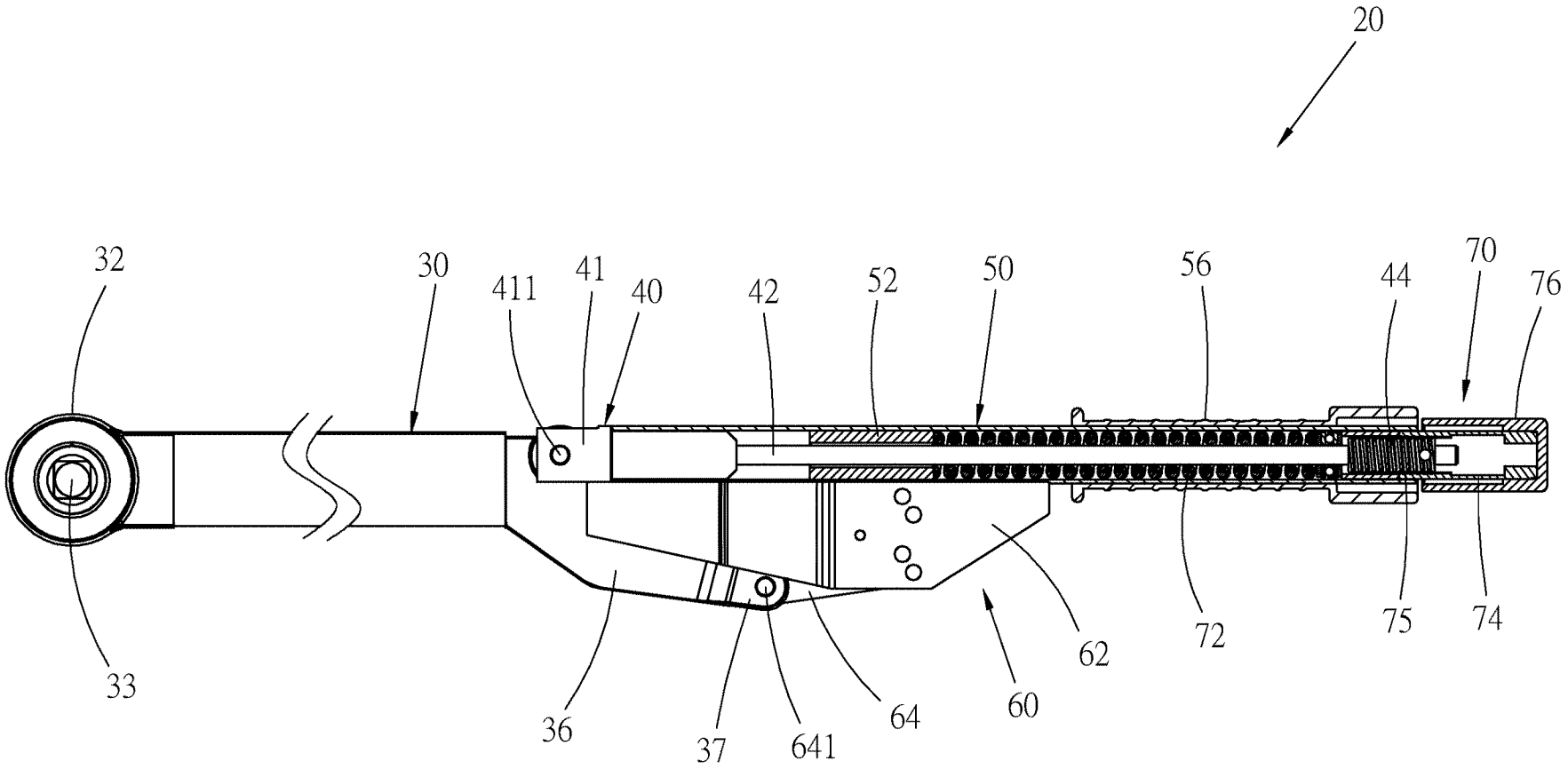
FIG. 4 is a view according to FIG. 3, in which the tubular body of the wrench is sectioned to show the inside of the tubular body.

Please refer to FIGS. 3 and 4. According to a first embodiment, the folding torque wrench 20 of the present invention includes a front portion and a front portion of the wrench. The front portion mainly includes a bar body 30. The front portion of the wrench mainly has a connection rod 40, a tubular body 50 and a torque adjustment mechanism 70.

A drive head 32 is disposed at a front end of the bar body 30. The drive head 32 can be a drive head of any type of wrench. In this embodiment, the drive head 32 is, but not limited to, a ratchet structure for illustration purposes only. The drive head 32 has an insertion pin 33 for connecting with a socket (not shown). The socket can be fitted onto a threaded member to wrench the threaded member. Please refer to FIG. 5. A first pivotal connection section 34 is disposed at a rear end of the bar body 30. The bar body 30 further has a forked arm 36 extending from the rear end of the bar body to one side. A rear end of the forked arm 36 forms a second pivotal connection section 37 of the bar body.

The connection rod 40 has a front end, which is a pivotal connection end with larger outer diameter. The connection rod 40 further has a rod body 42 securely connected with a rear end of the pivotal connection end 41. The rod body 42 has a diameter smaller than that of the pivotal connection end 41. A threaded section 44 with an (outer) thread is disposed at the rear end of the connection rod 40. The pivotal connection end 41 of the connection rod is pivotally connected with the first pivotal connection section 34 of the bar body via a pivot pin 411, whereby the connection rod 40 and the bar body 30 can be relatively rotated around the pivot pin 411 as a rotational fulcrum.

A front end of the tubular body 50 is fitted on the pivotal connection end 41 of the connection rod 40. The tubular body 50 is slidable relative to the connection rod in the longitudinal direction of the connection rod 40. An abutment section is disposed in the tubular body 50. In this embodiment, the abutment section is a fixed block 52, which is a hollow cylindrical body having an internal axial passage 54. The fixed block 52 is affixed to an inner wall of the tubular body 50. The rod body 42 of the connection rod 40 is received in the tubular body 50 and passed through the passage 54 of the fixed block 52. The rear end of the rod body 42 extends to the rear end of the tubular body 50. A handle 56 is securely disposed at the rear end of the tubular body 50 for a user to hold and operate the wrench.

Figure 5:
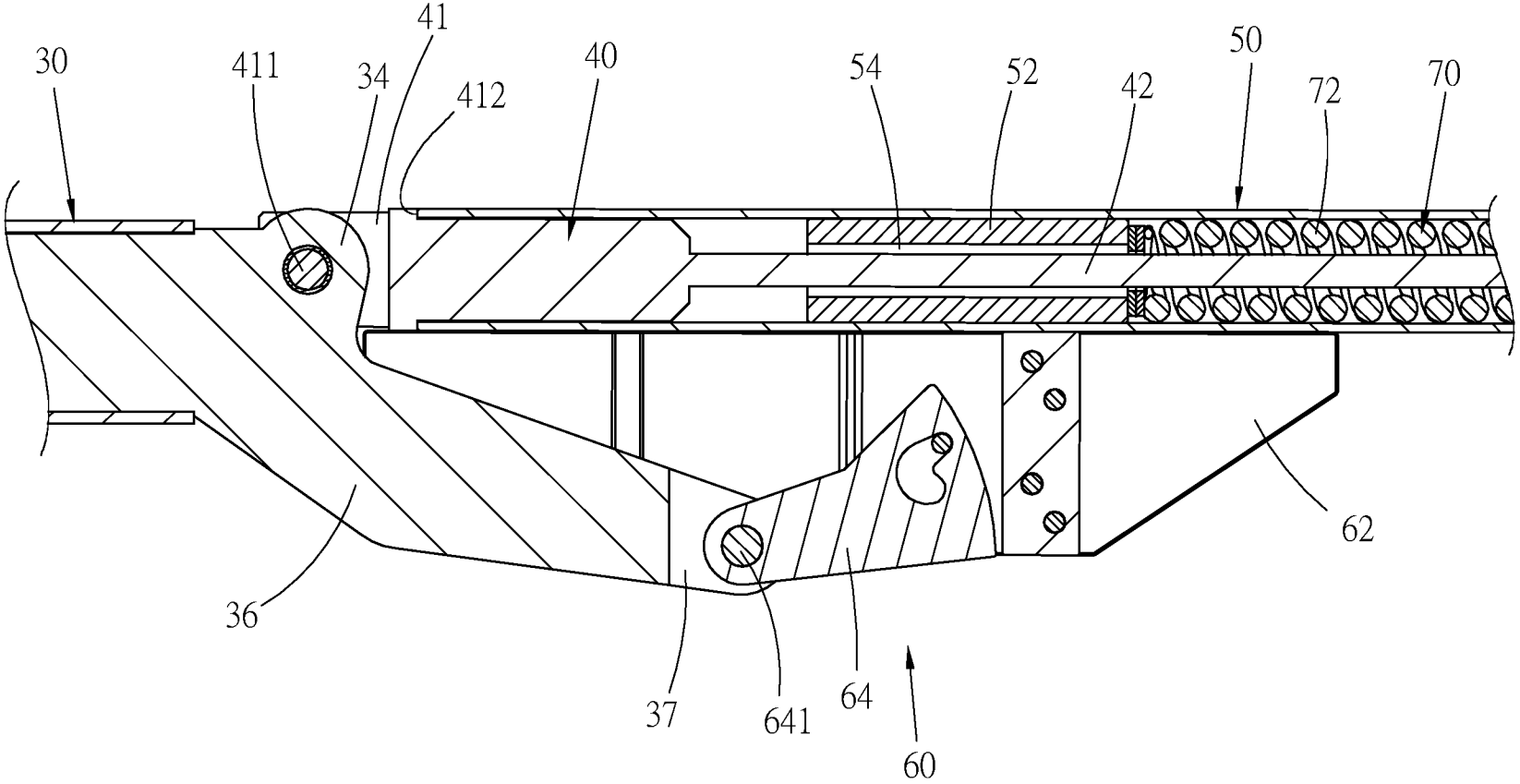
FIG. 5 is a sectional view showing the pivotal connection section between the front portion and the front portion of the wrench.

Please refer to FIG. 5. A linking mechanism 60 is disposed on one side of the tubular body 50. The linking mechanism 60 has a case 62 securely disposed on a circumference of the tubular body and a link member 64 disposed in the internal space of the case 62 and movable within the case. One end of the link member 64 is pivotally connected with the second pivotal connection section 37 of the bar body 30 via a pivot pin 641, whereby the link member 64 can be swung around the second pivotal connection section 37 as a rotational fulcrum. The linking mechanism 60 is not the subject of the present invention and thus will not be further described hereinafter.

Figure 6:
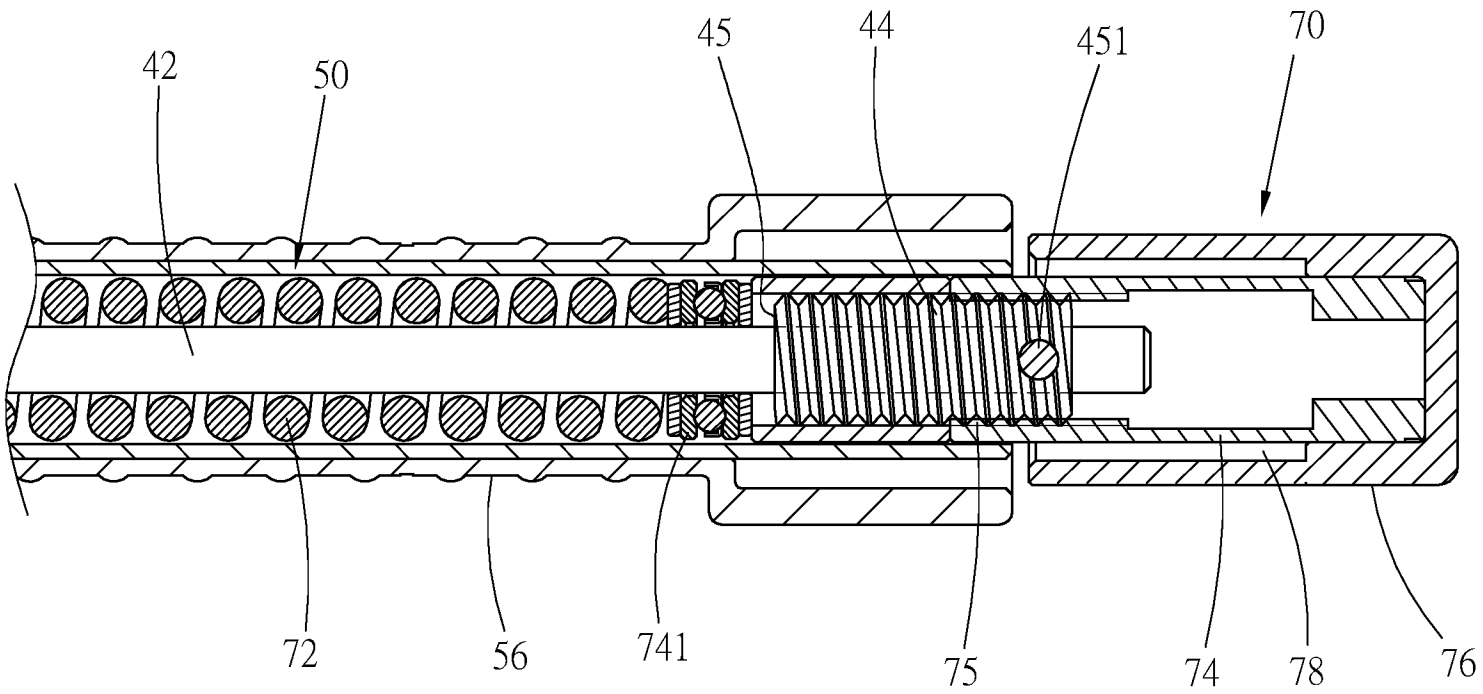
FIG. 6 is an enlarged view of a part of FIG. 4.

Please refer to FIGS. 4 and 6. The torque adjustment mechanism 70 is mounted in the tubular body 50. The torque adjustment mechanism 70 includes at least one elastic member 72 and an adjustment member 74. The elastic member 72 is a compression spring fitted on the rod body 42. The adjustment member 74 is a cylindrical body formed with an internal axial threaded hole 75. The threaded section 44 of the connection rod 40 is screwed in the threaded hole 75 with the (inner) thread of the threaded hole 75 screwed with the (outer) thread of the threaded section 44. The rear end of the adjustment member 74 outward protrudes from the tubular body 50. A cylindrical rotary button 76 with larger outer diameter is securely connected with the rear end of the adjustment member 74, whereby an operator can rotate the adjustment member 74 via the rotary button 76. Two ends of the elastic member 72 respectively abut against the fixed block 52 and the front end of the adjustment member 74. In practice, the front end of the adjustment member 74 abuts against the elastic member 72 via a bearing 741 or another component. The elastic member 72 applies elastic force to the fixed block 52, whereby the tubular body 50 is slid toward the front end of the connection rod 40. When the front end of the tubular body 50 touches the shoulder section 412 of the pivotal connection end 41, the tubular body 50 is located as shown in FIG. 5. When rotating the adjustment member 74, the adjustment member 74 is moved in the axial direction of the connection rod 40 to increase or decrease the elastic energy of the elastic member 72 so as to adjust and set the torque value of the wrench 20.

Figure 7:
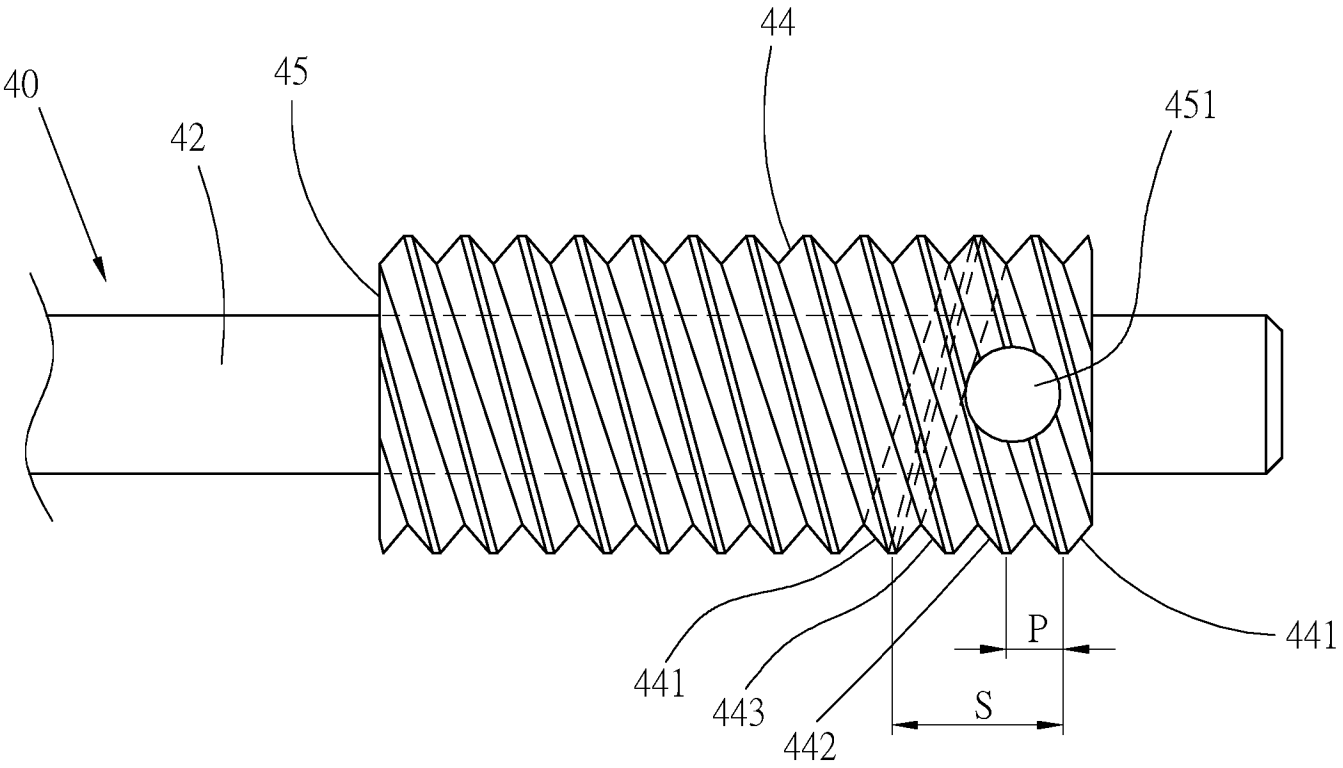
FIG. 7 is a view showing the threaded section of the connection rod of the present invention.

Please now refer to FIG. 7. In this embodiment, the rear end of the rod body 42 of the connection rod 40 has a large-diameter section 45. The large-diameter section 45 is formed of a hollow cylindrical body fitted on the rod body 42. The rod body 42 and the large-diameter section 45 are radially securely connected with each other by means of at least one fixing member such as at least one fixing pin 451. The threaded section 44 is formed on a circumference of the large-diameter section 45. The threaded section 44 is multi-start threads in a range of double-start threads to quadruple-start threads. In this embodiment, the threaded section 44 is triple-start threads 441, 442, 443 as shown in the drawings.

The diameter of the threaded hole 75 of the adjustment member 74 is adapted to the diameter of the large-diameter section 45. The threads of the threaded hole 75 can be single-start threads or multi-start threads and preferably multi-start threads. In this embodiment, the threaded hole 75 is made with triple-start threads (not shown) in cooperation with the threads of the threaded section 44. The triple-start threads of the threaded hole 75 can be known from the three threads 441, 442, 443 of the threaded section 44. The threaded section 44 of the connection rod 40 is screwed in the threaded hole 75 of the adjustment member 74. By means of the design of the triple-start threads, when rotating the adjustment member 74 by one circle, the adjustment member 74 is moved in the longitudinal direction of the connection rod 40 by a travel S, which is three time the pitch P of the threaded section 44.

It should be noted that the threaded section 44 and the threaded hole 75 are respectively formed as a first threaded section and a second threaded section screwed with each other. The first threaded section can be the threaded section 44 of the connection rod 40, while the second threaded section can be the threaded hole 75 of the adjustment member 74. Alternatively, the first threaded section can be the threaded hole 75 of the adjustment member 74, while the second threaded section can be the threaded section 44 of the connection rod 40. In practice, the travel S of the adjustment member 74 can be several time the pitch P with only at least one threaded section is designed with multi-start threads and it is unnecessary to design both the first and second threaded sections with multi-start threads. For example, the first threaded section (such as the threaded section 44) is formed with multi-start threads, while the second threaded section (such as the threaded hole 75) is formed with multi-start threads or single-start threads. In the case that the second threaded section is formed with single-start threads, the spiral form of the single-start threads is as one of the three threads 441, 442, 443 such as the thread 441 as shown in FIG. 7.

In normal state, the tubular body 50 of the wrench 20 is substantially in parallel to the bar body 30. The elastic member 72 applies elastic force to the fixed block 52 to push the tubular body 50 to slide forward (toward the bar body). When the front end of the tubular body 50 touches the shoulder section 412 of the pivotal connection end 41 of the connection rod 40, the tubular body 50 is located.

In operation, an operator holds the handle 56 to wrench the wrench 20 so as to rotate the threaded member. When the operation torque of the wrench 20 reaches the set torque value, the linking mechanism 60 will push the tubular body 50 to move backward. Under such circumstance, the tubular body 50 overcomes the elastic energy of the elastic member 72 to move backward. Accordingly, the front portion of the wrench (the tubular body 50 and the connection rod 40) is rotated around the pivot pin 411 as a fulcrum and bent from the bar body 30. At the same time, the link member 64 will angularly displace around the pivot pin 641 as a fulcrum. The bending state of the wrench 20 reminds the operator that the operation torque of the wrench 20 has reached the set torque value. The substantial bending process of the wrench that takes place when the operation torque of the wrench reaches the set torque value will not be redundantly described hereinafter.

When adjusting the set torque value of the wrench 20, the adjustment member 74 is rotated to move forward or backward in the longitudinal direction of the connection rod 40 so as to change the elastic energy of the elastic member 72 and increase or decrease the set torque value.

In this embodiment, the threads of the threaded hole 75 of the adjustment member 74 and the threads of the threaded section 44 of the connection rod 40 are designed with the triple-start threads 441, 442, 443. Therefore, when rotating the adjustment member 74 by one circle, the displacement travel S of the adjustment member 74 is three time the pitch P as shown in FIG. 7. The displacement travel is relatively large so that the adjustment member 74 can quickly move in the longitudinal direction of the connection rod 40 to quickly increase or decrease the elastic energy of the elastic member 72. By means of such design, when it is desired to adjust the set torque value of the wrench within a large range, for example, from 600 pound-feet to 700 pound-feet, a user only needs to rotate the adjustment member 74 by few circles to make the adjustment member displace by a large travel. For example, the adjustment member can be quickly moved from the position of FIG. 3 to the position of FIG. 8 by a long distance. Accordingly, the torque value of the wrench can be quickly adjusted within a large range.

Figure 8:
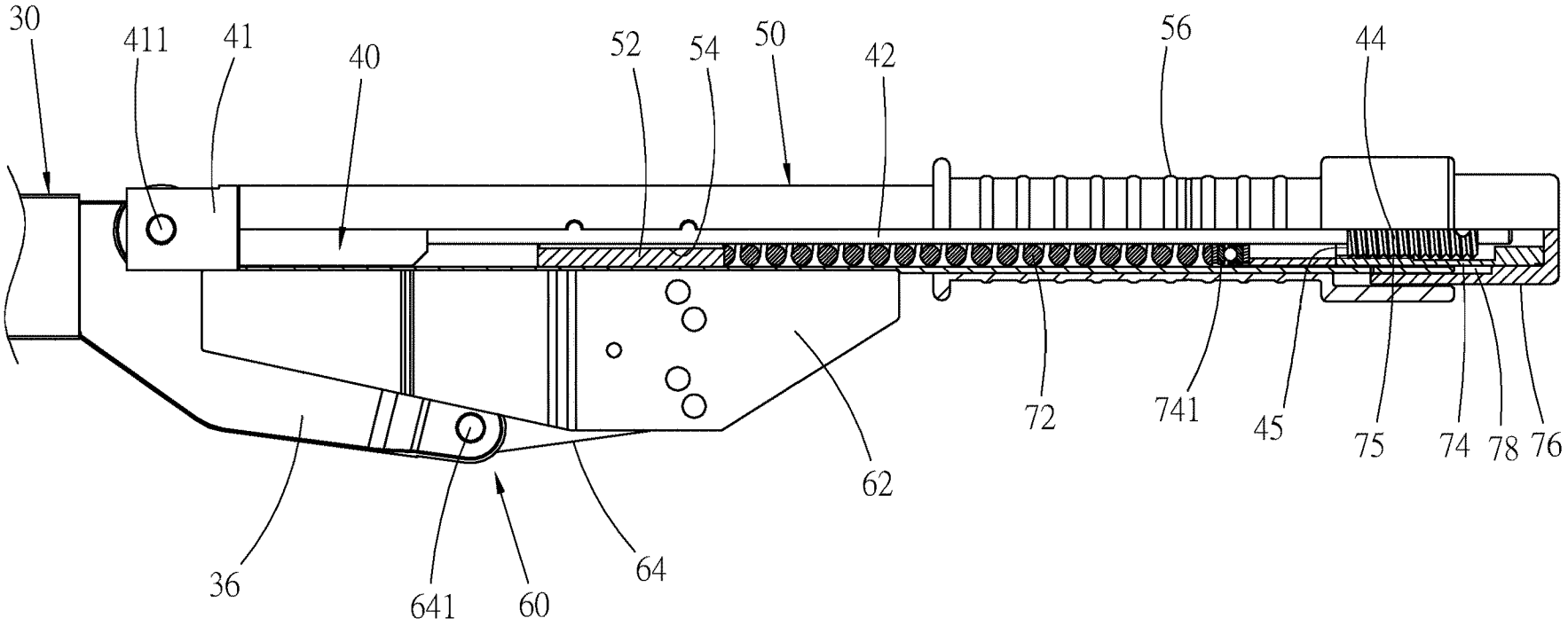
FIG. 8 is a view according to FIG. 3, showing that the wrench is adjusted to a greater set torque value.

Referring to FIG. 8, when the adjustment member 74 is moved toward the tubular body 50, the rear end of the tubular body 50 is moved into an annular space 78 defined between the inner circumference of the rotary button 76 and the outer circumference of the adjustment member 74.

The present invention is such designed that the threaded section 44 of the connection rod 40 and the threaded hole 75 of the adjustment member 74 have multi-start threads, which are screwed with each other. In this case, the set torque value of the wrench can be quickly adjusted to save time. Such design is especially applicable to those torque wrenches with large torque value and those torque wrenches with large torque value adjustment range.

In the preferred embodiment, the large-diameter section 45 is disposed on the rod body 42 and the threaded section 44 with the multi-start threads is disposed on the large-diameter section 45. In the condition that the original structure is unchanged, the structural strength of the screwing portion can be increased and the pitch P and the travel S can be enlarged so as to elongate the displacement distance of the adjustment member and speed the displacement of the adjustment member.

The above embodiments are only used to illustrate the present invention, not intended to limit the scope thereof. Many modifications of the above embodiments can be made without departing from the spirit of the present invention.

What is claimed is:

1. A folding torque wrench with fast adjustable torque value, comprising:

a bar body; a drive head being disposed at a front end of the bar body; a first pivotal connection section and a second pivotal connection section being disposed at a rear end of the bar body;

a connection rod having a pivotal connection end and a rod body; a threaded section being disposed at a rear end of the rod body; the pivotal connection end of the connection rod being pivotally connected with the first pivotal connection section of the bar body;

a tubular body fitted on the connection rod, the tubular body being slidable relative to the connection rod; the threaded section of the connection rod being positioned at a rear end of the tubular body;

a linking mechanism mounted on a circumference of the tubular body and pivotally connected with the second pivotal connection section of the bar body; and a torque adjustment mechanism having at least one elastic member and an adjustment member, the adjustment member being formed with a threaded hole, the threaded section of the connection rod being screwed in the threaded hole, the elastic member being disposed in the tubular body, two ends of the elastic member respectively abutting against the adjustment member and an abutment section of the tubular body;

wherein the threaded section of the connection rod and the threaded hole of the adjustment member being respectively formed as a first threaded section and a second threaded section, the first threaded section being multi-start threads of at least double-start threads; when rotating the adjustment member by one circle, the adjustment member is moved in the longitudinal direction of the connection rod by a travel, which is at least two time the pitch of the first threaded section;

wherein a large-diameter section is located on the rear end of the rod body of the connection rod opposite the pivotal connection end of the connection rod; the threaded section of the connection rod being located on a circumference of the large-diameter section.

2. The folding torque wrench as claimed in claim 1, wherein the second threaded section is multi-start threads of at least double-start threads.

3. The folding torque wrench as claimed in claim 2, wherein a hollow cylindrical body is fitted on and securely connected with the rod body to form the large-diameter section.

4. The folding torque wrench as claimed in claim 1, wherein the second threaded section is a single-start thread.

5. The folding torque wrench as claimed in claim 4, wherein a hollow cylindrical body is fitted on and securely connected with the rod body to form the large-diameter section.

6. The folding torque wrench as claimed in claim 1, wherein the first threaded section is triple-start threads; when rotating the adjustment member by one circle, the adjustment member is moved in the longitudinal direction of the connection rod by a travel, which is three time the pitch of the first threaded section.

7. The folding torque wrench as claimed in claim 6, further comprising at least one fixing member for securely connecting the rod body and the large-diameter section with each other.

8. The folding torque wrench as claimed in claim 1, wherein a hollow cylindrical body is fitted on and securely connected with the rod body to form the large-diameter section.

9. The folding torque wrench as claimed in claim 8, wherein a cylindrical rotary button is securely connected with the adjustment member; an annular space being defined between an inner circumference of the rotary button and an outer circumference of the adjustment member, when the adjustment member is moved toward the tubular body, the rear end of the tubular body is moved into the annular space.

10. The folding torque wrench as claimed in claim 1, wherein a cylindrical rotary button is securely connected with the adjustment member; an annular space being defined between an inner circumference of the rotary button and an outer circumference of the adjustment member, when the adjustment member is moved toward the tubular body, the rear end of the tubular body is moved into the annular space.

* * * * *